United States Patent [19]

Shiga

[11] 4,007,044

[45] Feb. 8, 1977

[54] COLOR ELECTROPHOTOGRAPHIC PROCESS

[75] Inventor: Tsuyoshi Shiga, Tokyo, Japan

[73] Assignee: Ricoh Co., Ltd., Tokyo, Japan

[22] Filed: Nov. 14, 1974

[21] Appl. No.: 525,421

[30] Foreign Application Priority Data

Dec. 11, 1973 Japan ..... 48-139342
Dec. 14, 1973 Japan ..... 48-140899

[52] U.S. Cl. ..... 96/1.2; 96/1.4; 355/4

[51] Int. Cl.[2] ..... G03G 13/22

[58] Field of Search ..... 96/1.2, 1.4; 355/4

[56] References Cited

UNITED STATES PATENTS

| | | | |
|---|---|---|---|
| 2,924,519 | 2/1960 | Bertelsen | 96/1.4 |
| 3,100,426 | 8/1963 | Kaprelian | 96/1.2 X |
| 3,166,418 | 1/1965 | Gunolach | 96/1.4 |
| 3,392,642 | 7/1968 | Germer | 96/1.4 X |
| 3,413,117 | 11/1968 | Gaynor | 96/1.2 |
| 3,807,998 | 4/1974 | Kinoshita | 355/4 X |
| 3,884,686 | 5/1975 | Bean | 96/1.2 X |

FOREIGN PATENTS OR APPLICATIONS

| | | | |
|---|---|---|---|
| 855,153 | 11/1970 | Canada | 96/1.2 |

*Primary Examiner*—Roland E. Martin, Jr.
*Attorney, Agent, or Firm*—Frank J. Jordan

[57] ABSTRACT

An overcoated photoconductive material is uniformly illuminated in the presence of an electric field to create persistent internal polarization. Minute, translucent toner particles are then applied onto the surface of the photoconductive member, and a colored light image is projected onto the surface of the photoconductive member through the toner particles. Equal numbers of the toner particles are colored in three primary colors respectively to form a tri-color mosaic pattern on the surface of the photoconductive member. Each particle absorbs light of its complementary color during the imaging step so that the internal polarization is dissipated in a pattern corresponding to a colored positive of the light image as quantized by the colored mosaic of toner particles. The particles which absorbed light, constituting a colored negative of the light image, are then selectively frictionally removed from the surface of the photoconductive member since the charge holding them to the surface is weak. The remaining particles, constituting a quantized positive of the light image, are then electrostatically transferred to a sheet of recording paper and fixed thereto to provide a positive colored copy. The particles which absorbed light may also be electrostatically transferred to a sheet or film of recording medium as a negative colored copy.

5 Claims, 12 Drawing Figures

COLOR ELECTROPHOTOGRAPHIC PROCESS

The present invention relates to a process and apparatus for color electrophotography.

In order to satisfy a need for colored copies of original documents, color electrophotographic processes have been devised and put into operation. In all of these systems, an optical image of the original document is sequentially projected through filters of three primary colors onto one or three photoconductive members, and toner particles in the three primary colors are applied to the one or three photoconductive members respectively to form three colored toner images which are sequentially transferred to a sheet of copy paper to reproduce the original colored document when superimposed one on the other. A main drawback of this type of process is excessive operating time since the three toner images must be transferred sequentially onto the sheet of copy paper. If one photoconductive drum is used for all three colors, it must be imaged three times through the three filters respectively, each resulting colored toner image transferred to the copy sheet and the photoconductive member cleaned after each transfer step. Another important drawback of such a prior art process is the complicated and precise mechanism required to embody it, since the three colored toner images must be transferred to the copy sheet in substantially perfect superimposition or register.

It is therefore an important object of the present invention to provide a color electrophotographic process which is simple, produces high quality color copies of an original document and overcomes the above described drawbacks of the prior art.

It is another important object of the present invention to provide apparatus embodying the above process.

The above and other objects, features and advantages of the present invention will become apparent from the following description taken in conjunction with the accompanying drawings, in which; FIG. 1 is a sectional view of a photoconductive member utilized in the present invention;

Figure 1:
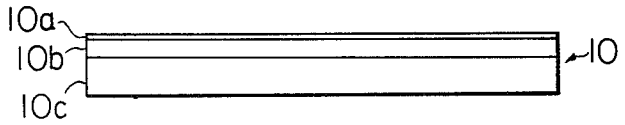

Referring now to FIG. 1, a preferred form of a photoconductive member 10 includes a transparent overcoating or insulating layer 10*a* bonded onto a photoconductive layer 10*b* which is in turn bonded to a support member or substrate layer 10*c*. Although the invention is not so limited and includes any suitable composition of the layers 10*a*, 10*b* and 10*c*, good practical results have been obtained in which the photoconductive member 10 was prepared as follows.

The substrate layer 10*c* was an aluminum plate 0.2mm thick. The photoconductive layer 10*b* was prepared from a cadmium sulfide powder containing $10^{-6}$% by weight of copper sulfide as a sensitizer and a resinous binder, said components being dispersed in toluene at a weight ratio of 5:2. The dispersion was coated onto the substrate layer 10*c* to a thickness of 80 microns. The insulating layer 10*a* was a polyester film 12 microns thick.

It will be noted that the photoconductive member 10 is shown in plate form in FIG. 1, but may be in any other convenient form such as cylindrical or endless belt form.

Figure 2:
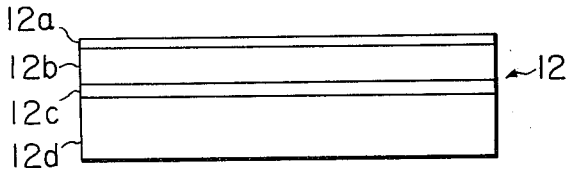
FIG. 2 shows an alternative form of the photoconductive member shown in FIG. 1.
Figure 3:
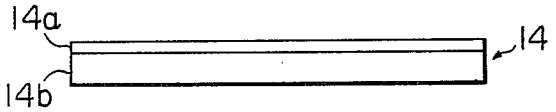
FIG. 3 shows another alternative form of the photoconductive member shown in FIG. 1.
Figure 4:
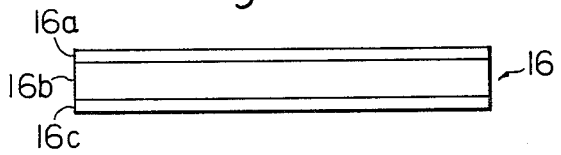
FIG. 4 shows still another alternative form of the photoconductive member shown in FIG. 1.

Alternative configurations of the photoconductive member 10 are shown in FIGS. 2 to 4 and designated as 12, 14 and 16 respectively. The photoconductive member 12 shown in FIG. 2 is identical to the photoconductive member 10 except that an additional insulating layer 12*d* is provided between a photoconductive layer 12*b* and a substrate layer 12*c*. The insulating layer 12*d* may or not be of the same material as a transparent insulating layer 12*a*, and does not have to be transparent. As shown in FIG. 3, only a transparent insulating layer 14*a* and a photoconductive layer 14*b* may be provided if desired. The configuration of the photoconductive member 16 shown in FIG. 4 is similar to the photoconductive member 12 shown in FIG. 2 except that only a transparent insulating layer 16*a*, a photoconductive layer 16*b* and an additional insulating layer 16*d* which does not have to be transparent are provided.

Figure 5:
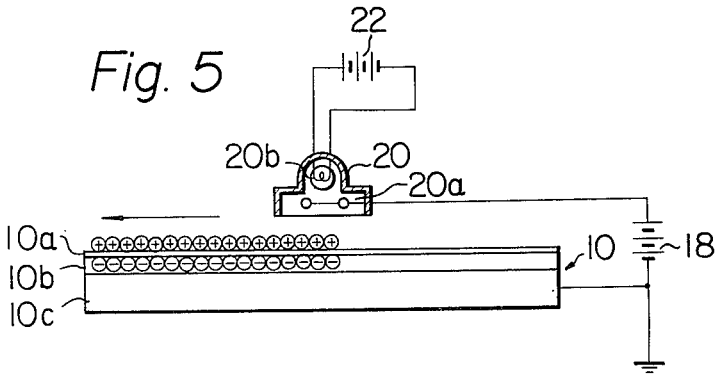
FIG. 5 is a sectional schematic view of the photoconductive member shown in FIG. 1 and an initial charging and uniformly illuminating apparatus in the operative condition.

A color electrophotographic process of the present invention will not be described with reference to FIGS. 5 to 9. Referring first to FIG. 5, the positive terminal of an 8000 volt direct current source 18 is connected to a corona discharge electrode 20*a* of a combined initial charging and illuminating unit 20, and the negative terminal of the source 18 is grounded. The substrate layer 10*c* of the photoconductive member 10 is also grounded. The unit 20 also comprises a lamp element 20*b* which is energized by a direct current source 22. In the first step of the color electrophotographic process, a positive corona discharge and uniform illumination are applied onto the upper surface of the insulating layer 10*a* by the electrode 20*a* and element 20*b* respectively. The electrode 20*a* produces positive ions which are deposited on the upper surface of the insulating layer 20*a* and designated by plus (+) signs enclosed by circles as the unit 20 is passed over the surface of the photoconductive member 10 in the direction of an arrow by drive means (not shown). Light transmitted through the transparent insulating layer 10*a* generates hole-electron pairs in the upper region of the photoconductive layer 10*b*. As the result of the positive ions on the upper surface of the layer 10*a*, liberated electrons designated by minus (−) signs enclosed by circles are attracted to the interface of the layers 10*a* and 10*b* as shown. Liberated holes (not shown) are repelled from the interface of the layers 10*a* and 10*b* toward the layer 10*c*, and many are neutralized by electrons injected into the bottom of the layer 10*b* from the layer 10*c*. Other liberated holes are trapped in the bulk of the layer 10*b*. As a result, when the sources 18 and 22 are de-energized, a persistent internal polarization (PIP) is established in the layer 10*b*. It will be realized by one skilled in the art that the illumination may be applied before or after the initial charging if desired. The potential at the surface of the layer 10*a* after performing the first step is about +700V due to the influence of the liberated electrons at the interface of the layers 10*a* and 10*b*.

Figure 6:
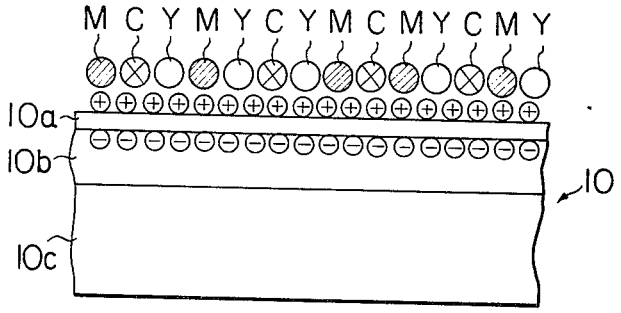
FIG. 6 is a sectional schematic view of the photoconductive member shown in FIG. 1 and colored toner particles applied onto the surface thereof.

In the next step of the process illustrated in FIG. 6, a homogeneous mixture of translucent toner particles is applied onto the surface of the layer 10*a*. The toner particles are minute in size and are constituted by equal numbers of particles designated as M, C and Y colored in the three primary colors magenta, cyan and yellow respectively. The toner particles may be prepared by coloring a transparent resin with pigment or dyestuff of the proper color and pulverizing the resin. In the example shown, the photoconductive layer 10*b* has a positive or P-type characteristic in that the majority carriers are holes. The polarity of the initial charge is chosen as positive so that holes liberated in the layer 10*b* near the interface of the layers 10*a* and 10*b* by the illumination will be urged to travel a greater distance than the minority carriers (liberated electrons) which accumulate near the interface of the layers 10*a* and 10*b*. Similarly, the toner particles are charged to a negative polarity by means not shown so as to be attracted to the positively charged layer 10*a*. If the layer 10*b* has an N-type characteristic, the initial charge is preferably negative and the toner particles are positively charged. However, any operable combination of the polarities of the elements described may be utilized within the scope of the present invention. As the result of the negative charge of the toner particles, the surface potential of the layer 10*a* drops to about +500V.

Figure 7:
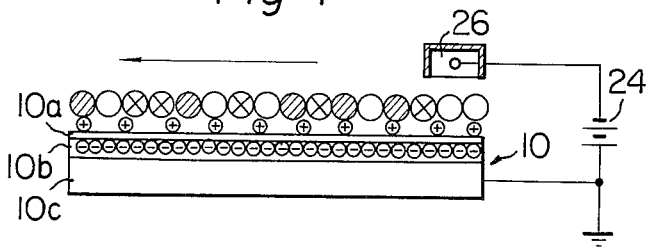
FIG. 7 is a sectional schematic view of the photoconductive member and toner particles shown in FIG. 6 and a secondary charging apparatus in the operative condition.

In the next step of the process shown in FIG. 7, a direct current source 24 is connected to apply a negative potential to a corona discharge unit 26 which moves relative to the photoconductive member 10 as indicated by an arrow. The voltage of the source 24 and the energization time thereof are selected so that negative ions are generated by the unit 26 in sufficient quantity to neutralize all but 10% to 50% of the positive ions generated in the step illustrated in FIG. 5. Due to the combined negative charge of the electrons in the layer 10*b* at the interface of the layers 10*a* and 10*b* and the toner particles, the surface potential of the layer 10*a* drops to about −700V. However, enough positive ions remain to attract the toner particles to the layer 10*a*. It will be noticed that this negative charging has no effect on the internal polarization of the layer 10*b* since no illumination is applied during this step.

Figure 8:
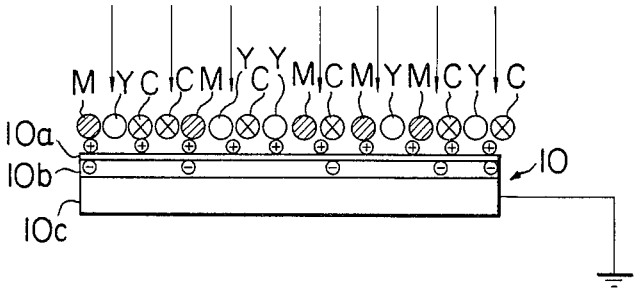
FIG. 8 is sectional schematic view of the photoconductive member and toner particles shown in FIG. 7 being exposed to a colored light image.

The next step of the process shown in FIG. 8, a colored optical or light image is projected onto the surface of the photoconductive member 10 through the toner particles. For simplicity of explanation, although the invention can reproduce optical images of any hues, it will be assumed that pure green light is projected onto the left side of the layer 10*a* and pure right light onto the right side thereof. One skilled in the art will recognize that red, green and blue are the complementary colors of cyan, magenta and yellow respectively, and that a filter of a primary color will absorb light of its complementary color. In FIG. 8, therefore, green light incident on the left side of the photoconductive member 10 will be absorbed by the magenta colored toner particles and transmitted through the cyan and yellow toner particles and the layer 10*a* into the layer 10*b*. Similarly, red light incident on the right side of the photoconductive member 10 will be absorbed by the cyan colored toner particles and be transmitted through the magenta and yellow toner particles and the layer 10*a* into the layer 10*b*. As a result, areas under the cyan and yellow toner particles in the left side of the layer 10*b* will conduct, with the result that holes will be injected from the layer 10*c* into the layer 10*b* to combine with and neutralize the electrons at the interface between the layers 10*a* and 10*b* in these areas as shown in FIG. 8. A similar phenomenon will occur with respect to areas under the magenta and yellow toner particles in the right side of the layer 10*b*. It will be understood that the areas under the magenta toner particles in the left side of the layer 10*b* and under the cyan toner particles in the right side of the layer 10*b* will not conduct, and the electrons at the interface of the layers 10*a* and 10*b* will remain in these areas (will not be neutralized). Sine magenta is the complementary color of green and cyan is the complementary color of red, the electrons remaining in the layer 10*b* at the interface of layers 10*a* and 10*b* represent a color negative or complementary image of the optical image projected onto the photoconductive member 10. Similarly, the pattern of neutralized electrons represents a color positive image of the original image. In the left side of the layer 10*b*, the neutralized electrons were under the cyan and yellow toner particles, and the combination of cyan and yellow is green, which was the color of the light incident on the left side of the member 10. In the right side of the layer 10*b*, the neutralized electrons were under the magenta and yellow toner particles, and the combination of magenta and yellow is red, which was the color of the light incident on the right side of the member 10.

In accordance with the present invention, either or both of the positive and negative images may be transferred to a sheet of recording medium. In the example shown in FIG. 9, the toner particles constituting the negative image are removed by electrostatic or physical means to leave the toner particles constituting the positive image. In the left side of the layer 10*b*, the cyan and yellow toner particles are strongly attracted to the member 10 due to the positive ions on the surface of the layer 10*a*. In the areas of the layer 10*b* under the magenta toner particles, the electrons at the interface of the layers 10*a* and 10*b* remain to counteract the charge of the positive ions on the surface of the layer 10*a*. Thus, the electrostatic force between the member 10 and the magenta toner particles is weak compared to the electrostatic force between the member 10 and the cyan and yellow toner particles. The effect is similar in the right side of the layer 10*b*, in which the cyan toner particles underneath which electrons remain are weakly attracted to the member 10 whereas magenta and yellow toner particles, underneath which the electrons have been neutralized are strongly attracted to the member 10. In areas in which the electrons were neutralized, it was found that for an imaging intensity of 240 lux/sec, the surface potential of the member 10 became about +150V, providing high electrostatic contrast.

The point of greatest novelty of the present invention is the translucent toner particles colored in three primary colors respectively, which serve the dual purpose of color filters and a developing agent to produce a visual colored image from an electrostatic latent image. The toner particles are minute in size, and the visual effect is similar to that of conventional half-tone printing, in which small dots in three primary colors are utilized to produce a colored image comprising any hues by varying the relative intensity of the dots. This is because dots of a given size and spacing are perceived as a continuous mass at a given viewing distance by the human eye, and the colors of the dots are blurred together to produce a color which is a combination of the colors of the dots and depends on their relative intensity. With this fact in mind, it willl be realized that any operable electrophotographic process incorporating the dual use of colored toner particles as color filters and a developing agent lies within the scope of the present invention.

It will be immediately realized that the process described above is a discharge type persistent internal polarization process utilizing hetrocharge conduction. A homocharge system may be also adopted, although not illustrated. In such a homo-charge system, it will be assumed for simplicity of description that the photoconductive member comprises only a grounded substrate layer with a photoconductive layer of P-type selenium vacuum evaporated thereon. The surface of the photoconductive layer is exposed to positive corona discharge without illumination to form a layer of positive ions thereon. The toner particles, having a negative charge, are then applied on the surface of the photoconductive layer. The photoconductive member is then imaged through the toner particles, and the positive ions are retained under toner particles of colors complementary to the color of the incident light and dissipated under the other toner particles through conduction of the layer 10*b* and injection of electrons from the substrate layer. In this case, however, the ions retained after imaging are positive, and serve to attract toner particles rather than repel them. Thus, the toner particles constituting the negative image are attracted to the photoconductive member stronger than these constituting the positive image.

If desired, a charge type hetrocharge system (PIP) may be adapted using the photoconductive member 10 shown in FIG. 1. In this case, the insulating layer 10*a* is exposed to positive corona discharge without illumination to form a layer of positive ions on the surface of the layer 10*a*. The corona discharge has no effect on the internal structure of the layer 10*b*. The negative toner particles are then applied onto the surface of the layer 10*a*, and the photoconductive member 10 is imaged through the toner particles. The layer 10*b* will not conduct under toner particles of colors complementary to the color of the incident light so that these toner particles, constituting the negative color image, will remain strongly attracted to the photoconductive member 10. However, light will be transmitted through the other toner particles causing hole-electron pairs to be generated in the layer 10*b* thereunderneath. The positive electrical field of the positive ions on the surface of the layer 10*a* will urge the liberated electrons to move to the interface of the layers 10*a* and 10*b* and urge the liberated holes to move toward the substrate layer 10*c* to combine with electrons injected therefrom. When the imaging light is removed, the liberated electrons and holes will remain in their displaced positions to create persistent internal polarization in the layer 10*b*. The electrons at the interface of the layers 10*a* and 10*b* will weaken the effect of the positive ions on the toner particles so that the toner particles constituting the positive color image will be weakly attracted to the photoconductive member 10. It will be realized by one skilled in the art that the process generic to all three systems described herein comprises the steps of charging the surface of the photoconductive member to a first polarity, applying the translucent toner particles having an opposite polarity, imaging the photoconductive member through the toner particles to cause the photoconductive member to conduct in accordance with the relationship between the colors of the toner particles and the imaging light, and removing the toner particles constituting one of the positive or negative images.

Figure 9:
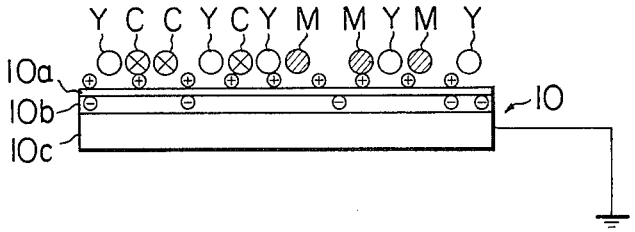
FIG. 9 is a sectional schematic view of the photoconductive member and some of the toner particles shown in FIG. 8 which constitute a colored toner image.
Figure 10:
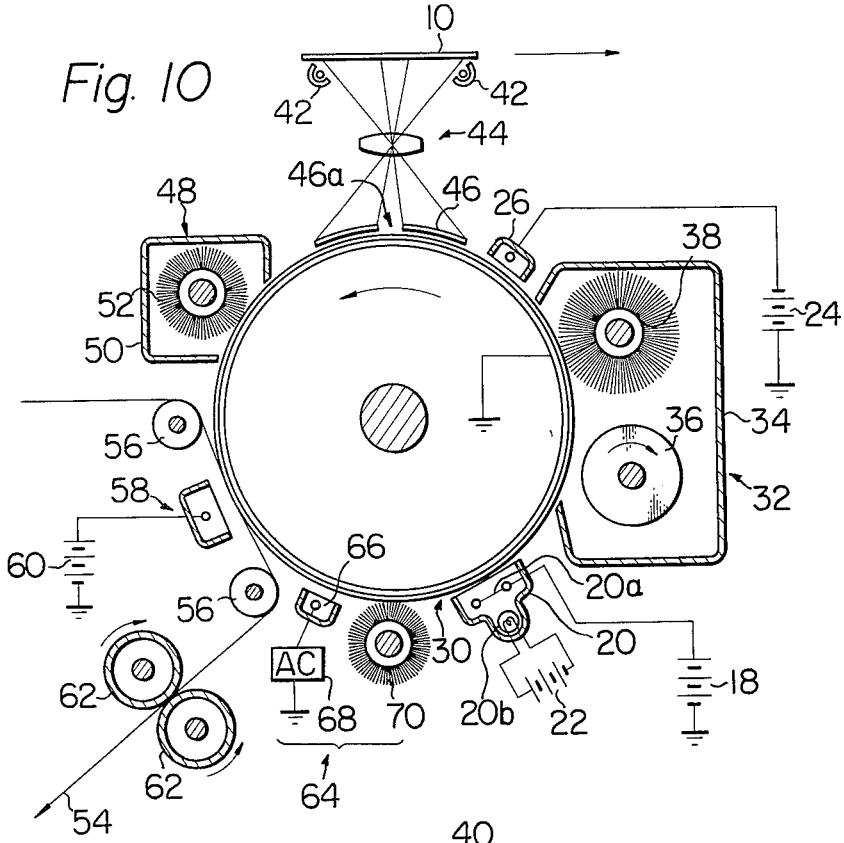
FIG. 10 is a sectional elevation of color electrophotographic apparatus embodying the present invention.

An apparatus to carry out the process described with reference to FIGS. 5 to 9 is shown in FIG. 10. The photoconductive member 10 is shown here as a drum 30, having the same composition as the member 10 with the transparent insulating layer (not designated) facing outwards. The unit 20 for the initial charging and illumination is disposed adjacent to the surface of the drum 30, which is rotated counterclockwise as indicated by an arrow. An applicator unit 32 includes a tank 34 filled with the toner particles described above in detail. A magnetic applicator roller 36 is adapted to homogenize and pick up the toner particles and apply them onto the surface of the drum 30, and rotates clockwise. A brush 38 contacting the surface of the drum 30 is arranged to evenly distribute the toner particles on the drum 30. Although it is desirable that the toner particles be applied onto the surface of the drum 30 in a layer only one particle thick as shown in FIGS. 6 to 9, it has been determined experimentally that good results may be obtained even if the layer of toner particles is two or three particles thick. The corona discharge unit 26 is arranged adjacent to the surface of the drum 30 downstream of the applicator unit 32.

An original colored document 40 to be copied is moved rightward as shown by an arrow in synchronism with the rotation of the drum 30, and is illuminated by white lights 42. An image of the document 40 is projected onto the surface of the drum 30 by a lens 44 and a mask 46 having an elongated slot 46*a* formed therethrough parallel to the axis of the drum 30. A removal unit 48 comprises a tank 50 enclosing a brush 52 in contact with the surface of the drum 30. Both brushes 38 and 52 may be made of Angora wool or a fur material, and the hardness of the brush 52 is preferably greater than that of the brush 38.

A sheet of copy paper or similar recording medium 54 is shown as provided in strip form and guided in the direction of an arrow in contact with the surface of the drum 30 by guide rollers 56. A transfer corona discharge unit 58 is supplied with a positive potential by a positive direct current source 60, and is arranged so that the medium 54 passes between the unit 58 and the drum 30 at the point of contact of the medium 54 and drum 30. Toner particles transferred from the drum 30 to the medium 54 are fixed to the medium 54 by heated fixing rollers 62 which rotate as indicated by arrows and between which the medium 54 passes. A cleaning unit 64 includes an alternating current corona discharge unit 66 supplied with alternating current from an alternating current source 68 and a brush 70 for removing residual toner particles from the surface of the drum 30.

In operation, the surface of the drum 30 is subjected to simultaneous positive corona discharge and illumination by the unit 20 to produce the effects described hereinabove with reference to FIG. 5. Toner particles are then applied onto the surface of the drum 30 by the applicator unit 32 as shown in FIG. 6. Subsequently, the surface of the drum 30 is subjected to negative corona discharge by the unit 26 as shown in FIG. 7. An image of the document 40 is then projected onto the surface of the drum 30 through the toner particles as shown in FIG. 8, although FIG. 8 shows an extremely simple color image. The removal unit 48 then removes the toner particles constituting the negative image as shown in FIG. 9. As the medium 54 is fed in contact with the drum 30, the unit 58 applies a positive potential through the medium 54 to attract the negative toner particles constituting the positive image onto the surface of the medium 54. These toner particles are thermally fixed onto the surface of the medium 54 to provide a positive color copy of the document 40. It is assumed that these operations are performed on each operative portion of the drum 30 sequentially as the drum 30 rotates.

Next, the unit 66 applies an AC corona discharge to the surface of the drum 30 to neutralize or discharge the drum 30, and the brush 70 removes any residual toner particles from the drum 30 to prevent double printing. These operations are repeated in an identical manner to make another copy of the document 40 to make a copy of another document.

Figure 11:
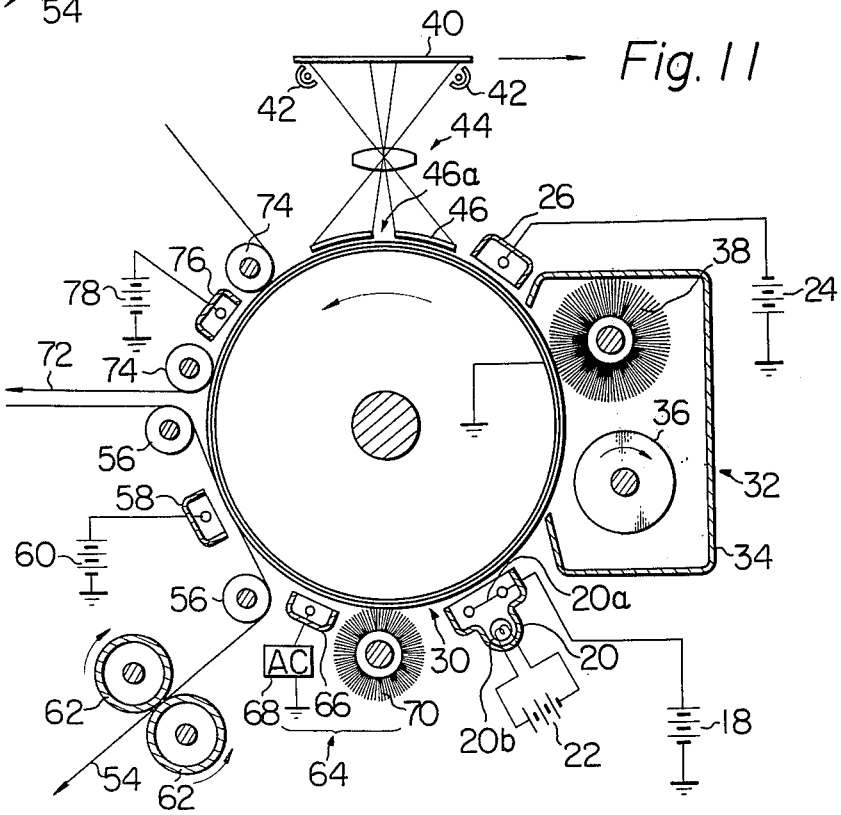
FIG. 11 is similar to FIG. 10 and shows a modification of the apparatus shown therein.

A modified arrangement of the embodiment of FIG. 10 is shown in FIG. 11, and is identical to that shown in FIG. 10 except that the removal unit 48 is replaced with means for transferring the toner particles constituting the negative image onto a recording medium prior to transferring the toner particles constituting the positive image onto the medium 54. A recording medium 72, guide rollers 74 and a corona discharge unit 76 are identical to the medium 54, guide rollers 56 and corona discharge unit 58. A direct current source 78 is arranged to supply a positive potential to the unit 76, but the potential of the source 78 is lower than that of the source 60.

More specifically, with consecutive reference to FIG. 9, it will be seen that the toner particles constituting the negative image are attracted to the member 10 with a lower electrostatic force than the toner particles constituting the positive image due to the presence of the electrons remaining at the interface of the layers 10*a* and 10*b*. Thus, they can be removed from the member 10 by a lower electrostatic force than the toner particles constituting the positive image. The potential of the source 78 is selected to that the positive electrical potential applied to the drum 30 through the medium 72 is sufficient to attract the toner particles constituting the negative image away from the drum 30 and onto the surface of the medium 72 but insufficient to remove the toner particles constituting the positive image from the surface of the drum 30. Fixing rollers similar to the rollers 62 are provided for the medium 72 although not shown. It will thus be understood that a negative color reproduction of the document 40 is provided on the medium 72 and subsequently a positive color reproduction of the document 40 is provided on the medium 54.

Figure 12:
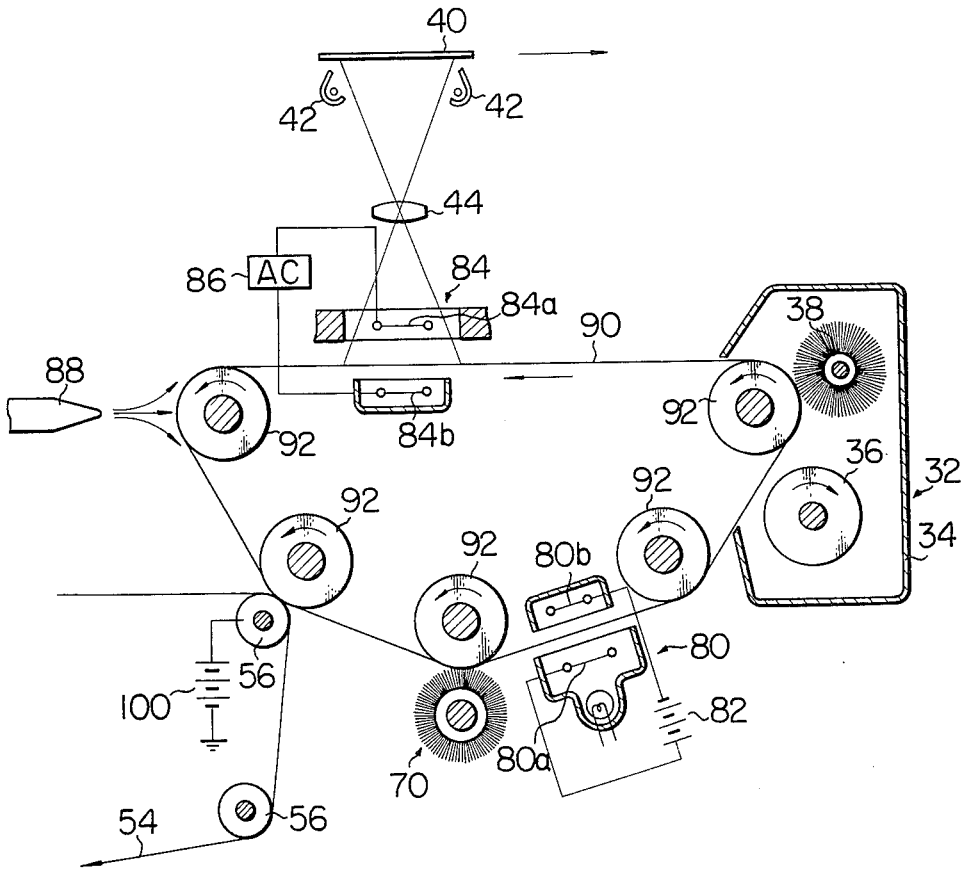
FIG. 12 is similar to FIGS. 10 and 11 but shows the apparatus as even further modified.

Referring now to FIG. 12, a photoconductive element in the form of an endless belt 90 has the cross section of the photoconductive member 16 shown in FIG. 4 with the transparent insulating layer oriented outwards. The belt 90 is driven and guided by rollers 92 as indicated by arrows. An initial charging and illuminating unit 80 differs from the unit 20 shown in FIG. 10 in that a direct current source 82 is adapted to supply a positive potential to a corona discharge electrode 80*a* and a negative potential to a corona discharge electrode 80*b* disposed on opposite sides of the belt 90. Referring to FIG. 4, the positive electrode 80*a* faces the side of the belt 90 corresponding to the layer 16*a* and the negative electrode 80*b* faces the side corresponding to the layer 16*d*.

A secondary charging unit 84 comprises a transparent corona discharge electrode 84*a* and a corona discharge electrode 84*b* arranged on opposite sides of the belt 90. The lens 44 is arranged to image the belt 90 through the electrode 84*a*. An alternating current source 86 applies an alternating potential to the electrodes 84*a* and 84*b*.

A compressed air knife or jet 88 is arranged downstream of the unit 84 and replaces the removal unit 48 shown in FIG. 10. If desired, the jet 88 may be replaced with a vacuum source. The medium 54 is shown as in FIG. 10 in conjunction with the rollers 56. However, one of the rollers 56 is designated as 56′ since it is charged to a positive electrical potential by a direct current source 100.

In operation, the belt 90 is subjected to corona discharge and simultaneous uniform illumination by the unit 80. The effect is similar to that described with reference to FIG. 5 except that since there is no substrate layer there is no charge injection therefrom, and the charge carriers are contained within the photoconductive layer. The colored toner particles are then applied onto the surface of the belt 90 by the applicator unit 32. The belt 90 is then imaged through the transparent electrode 84 and toner particles and simultaneously subjected to alternating current corona discharge by the electrodes 84*a* and 84*b*. As discussed in U.S. Pat. No. 3,676,117, for example, the same effect as that produced by the secondary charging unit 26 in FIG. 10 can be produced by the secondary charging unit 84 shown in FIG. 12, because the half cycles of the AC field having the same polarity as the field produced by the unit 80 do not alter the distribution of charge and only the other half cycles of the opposite polarity contribute to the formation of the secondary field. This phenomenon is well known in the art and was verified experimentally.

Next, the toner particles constituting the negative image are removed from the surface of the belt 90 by the air jet 88. The toner particles constituting the positive image are transferred to the medium 54 in a manner similar to that described with reference to FIG. 10 except that the positive electrical is applied through the medium 54 to the belt 90 by means of the positively charged roller 56′ rather than the corona discharge unit 58. The belt 90 may also have the cross section shown in FIG. 2, in which case the unit 20 shown in FIG. 10 would be used rather than the unit 80 for initial charging and the substrate layer corresponding to the substrate layer 12*c* shown in FIG. 2 would be grounded through the rollers 92. The secondary charging unit 84 would be adapted to apply an alternating potential to only the transparent insulating layer of the belt 90 with the electrode 84*b* omitted and one terminal of the source 86 grounded. The photoconductive member 12 shown in FIG. 2 may also be used in the apparatus shown in FIGS. 10 and 11, as the insulating layer 12*d* serves the purpose of preventing charge injection from the substrate layer 12*c*. The photoconductive member 14 shown in FIG. 3 may also be utilized in an apparatus such as these shown, in which case charging units such as the unit 80 would be used to charge both sides of the member 14.

From the foregoing description, the scope of the invention will be understood as including any operable electrophotographic process for producing a negative or positive color reproduction of an original which utilizes the colored toner particles as both color filters and a developing agent. For example, when an electrophotographic material exhibiting persistent internal polarization properties is exposed to energizing illumination, hole-electron pairs are created due to the absorption of photon energy. If the illumination is removed, some of the liberated holes and electrons will re-combine, but a great number will be retained in energy traps of varying depth in physical separation from each other. Subsequent application of an electrical field will then cause the trapped holes and electrons to move in opposite directions depending on their mobility to create a state of persistent internal polarization. In addition, if an ionic layer is deposited on at least one surface of a photoconductive material overcoated by an insulating layer, the electrical field of the ions will cause charge carrier movement if the photoconductive member is subsequently illuminated by energizing radiation. Therefore, it will be understood that the initial and secondary charges may be applied before, in simultaneity with or after the initial uniform illumination and the imaging illumination respectively. Furthermore, the secondary charge may be direct current or alternating current. If desired, the proportions of the mixture of toner particles may be other than equal with regard to the colors to provide a tinted color reproduction for special effects.

What is claimed is:

1. A color electrophotography process, comprising the steps of:

a. applying an electrostatic charge to a photoconductive member having a protective transparent insulating layer formed on a surface thereof to create a charge of a first polarity at the surface, the insulatig layer being bonded onto a photoconductive layer which is bonded to a conductive support layer;

b. uniformly illuminating the insulating layer;

c. applying a thin layer of a homogeneous mixture of translucent particles onto the insulating layer, the particles having a charge of a second polarity opposite to the first polarity and being provided in substantially equal numbers colored in three primary colors respectively;

d. applying a colored light image onto the insulating layer through the particles, the particles absorbing light of their complementary colors respectively;

e. applying a force to the insulating layer to remove particles from areas of the insulating layer where the electrostatic force between the photoconductive member and the particles has been reduced below a predetermined value during step *d;* f. transferring the particles remaining on the insulating layer to the surface of a recording medium after performing step *e*.

2. The process according to claim 1, in which step *b* is performed prior to step *a*.

3. The process according to claim 1, in which the force applied in step *e* is frictional.

4. The process according to claim 1, further comprising, in simultaneity with step *e*, the step of:

h. transferring the particles removed by performing step *e* to the surface of a recording medium.

5. The process according to claim 4, in which the force applied in step *e* is electrostatic.

* * * * *